US007762653B2

(12) United States Patent
Sakurai

(10) Patent No.: US 7,762,653 B2
(45) Date of Patent: Jul. 27, 2010

(54) TUBE AND METHOD OF USING THE SAME

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 769 days.

(21) Appl. No.: 11/598,330

(22) Filed: Nov. 13, 2006

(65) Prior Publication Data

US 2007/0109367 A1 May 17, 2007

(30) Foreign Application Priority Data

Nov. 14, 2005 (JP) ..... 2005-328727

(51) Int. Cl.
*B41J 2/175* (2006.01)

(52) U.S. Cl. ..... 347/85

(58) Field of Classification Search ..... 347/84, 347/85, 86, 87; 138/137, 138, 140, 141; 428/35.9, 36.91
See application file for complete search history.

(56) References Cited

U.S. PATENT DOCUMENTS

| | | | | |
|---|---|---|---|---|
| 5,025,270 | A * | 6/1991 | Umezawa | 347/85 |
| 5,360,037 | A * | 11/1994 | Lindstrom | 138/138 |
| 5,473,354 | A * | 12/1995 | Arquilevich et al. | 347/85 |
| 5,731,527 | A * | 3/1998 | Van Cleve | 73/861.355 |
| 5,988,801 | A * | 11/1999 | Coiner | 347/85 |
| 6,974,614 | B2 * | 12/2005 | Smith et al. | 428/35.9 |
| 7,281,547 | B2 * | 10/2007 | Cleveland et al. | 138/137 |
| 2003/0218660 | A1 | 11/2003 | Matsumoto et al. | |
| 2005/0024449 | A1 | 2/2005 | Shiho et al. | |
| 2005/0083382 | A1 | 4/2005 | Shiho et al. | |
| 2005/0140752 | A1 | 6/2005 | Shiho et al. | |

FOREIGN PATENT DOCUMENTS

| | | |
|---|---|---|
| JP | 2-10036 | 1/1990 |
| JP | 6-745 | 1/1994 |
| JP | 6-746 | 1/1994 |
| JP | 9226152 | 9/1997 |
| JP | 9226153 | 9/1997 |
| JP | 9300652 | 11/1997 |
| JP | 10278289 | 10/1998 |
| JP | 11257550 | 9/1999 |
| JP | 2001026119 | 1/2001 |
| JP | 2002011891 | 1/2002 |
| JP | 200-320680 | 11/2003 |

* cited by examiner

*Primary Examiner*—Anh T. N. Vo
(74) *Attorney, Agent, or Firm*—Frommer Lawrence & Haug LLP

(57) ABSTRACT

A tube for supplying a fluid therethrough having a base wall and an enlarged wall is provided. The base wall is outside a first closed line segment which defines an inside of the inner surface of the tube and is inside a second closed line segment which is similar to the first closed line segment and encloses the first closed line segment with a gravity center of the second closed line segment coincident with a gravity center of the first closed line segment. And the enlarged wall is outside the second closed line segment and is inside a third closed line segment which encloses the second closed line segment, wherein either the third closed line segment is dissimilar to the second closed line segment or a gravity center of the third closed line segment is different from that of the second closed line segment.

19 Claims, 5 Drawing Sheets

TUBE AND METHOD OF USING THE SAME

CROSS-REFERENCE OF RELATED APPLICATION

This non-provisional application claims priority under 35 U.S.C. §119(a) on Patent Application No. 2005-328727 in Japan on Nov. 14, 2005, the entire contents of which are hereby incorporated by reference.

BACKGROUND

The present invention relates to a tube and a method of using the same for supplying a fluid.

A tube (An ink tube) for supplying an ink has commonly a circular form in the cross section of which both the inner and outer surfaces are concentric, as disclosed in Japanese Patent Application Laid-Open No. 10-278289 (See FIG. 1).

BRIEF SUMMARY

When a wall of an ink tube is gas permeable, water in the ink may often be evaporated and escaped from the ink tube. As the result, the ink will be increased in viscosity. Alternatively, air which intrudes into the ink tube from the outside dissolves in the ink, so that the ink declines in quality.

For attenuating the gas permeability of the ink tube, it is a good idea to increase the thickness of the wall of the ink tube. In order to realize a ink tube which is less gas permeability that the ink tube having the cross section shown in FIG. 3A, the thickness of the wall may increase while its inner and outer surfaces remaining concentric as shown in FIG. 3B.

However, when its thickness is only increased as shown in FIG. 3B, the ink tube can be bent in all the directions in the same way with difficulty and not applied while remaining bent such as ink tubes 100*a* to 100*d* shown in FIG. 1. Further, since the ink tube having been increased in thickness becomes greater in resistance to tensile stress or compression stress when being bent, in the case of remaining a bent form for a long time, the ink tube may deteriorate in quality.

It is an object to provide an ink tube being suitable for use in a bent form and lower in both deterioration in the case of remaining the bent form for a long time and in the gas permeability.

An ink tube according to one aspect is a tube for supplying a fluid therethrough, comprising: a base wall, from the viewpoint of the cross section vertical to a longitudinal direction of the tube, being outside a first closed line segment which defines an inside of the inner surface of the tube and being inside a second closed line segment which is similar to the first closed line segment and encloses the first closed line segment with a gravity center of the second closed line segment coincident with a gravity center of the first closed line segment; and an enlarged wall, from the viewpoint of the cross section vertical to the longitudinal direction of the tube, being outside the second closed line segment and being inside a third closed line segment which encloses the second closed line segment, wherein either the third closed line segment is dissimilar to the second closed line segment and a gravity center of the third closed line segment is coincident the gravity center of the second closed line segment or the third closed line segment is similar to the second closed line segment and a gravity center of the third closed line segment is different from the gravity center of the second closed line segment.

The aspect has the following advantages. In the case where either the third closed line segment is not similar to the second closed line segment and the gravity center of the third closed line segment is coincident that of the second closed line segment or the third closed line segment is similar to the second closed line segment and the gravity center of the third dosed line segment is different from that of the second closed line segment, the enlarged wall at the cross section is biased in either of the two opposite directions. Therefore, when the ink tube is bent in one of the two opposite directions, the maximum of the compression stress or the tensile stress received at the outer surface becomes smaller than when it is bent in the other direction. Accordingly, the ink tube can selectively be bent in such a direction that the compression stress or the tensile stress to be received is minimized. Further, since the ink tube having the enlarged wall is greater in the size of the cross section than any ink tubes having only a base wall, it can be improved in vapor barrier property and gas barrier property between the inside and the outside of the ink tube.

The above and further objects and features will more fully be apparent from the following detailed description with accompanying drawings.

DETAILED DESCRIPTION

Some embodiments will be described below. First, an ink jet printer equipped with ink tubes will be described. Next, ink tubes according to a preferred embodiment will be described in more detail.

(Concept of Printer)

Figure 1:
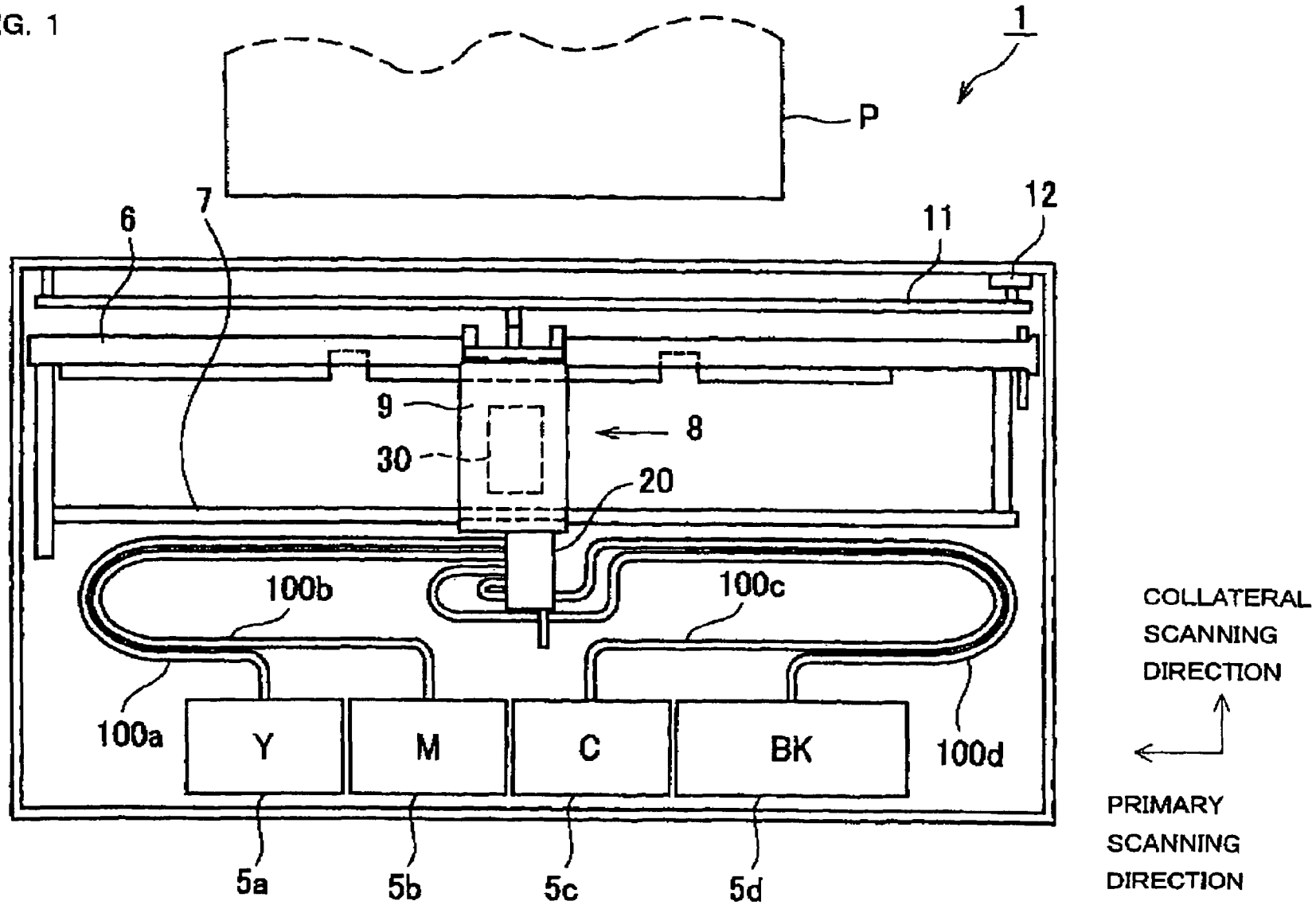
FIG. 1 shows a top view of the interior of a printer in which ink tubes according to an embodiment are used.

FIG. 1 illustrates an ink jet printer 1 (printer) equipped with ink tubes. FIG. 1 is a top view showing the interior of the printer 1.

The printer 1 includes two guide shafts 6 and 7 therein. A head unit 8 is mounted on the guide shafts 6 and 7 as a carriage for traveling forward and backward along a primary scanning direction. The head unit 8 has a head holder 9 made of a synthetic resin material. The head holder 9 holds an ink jet head 30 for delivering a jet of ink onto a sheet of printing paper P which is conveyed beneath the head unit 8.

The printer 1 includes a carriage motor 12. An endless belt 11 is mounted on the driving shaft of the carriage motor 12 and can thus rotate by driving of the carriage motor 12. The head holder 9 is linked to the endless belt 11 and can be moved forward and backward along the primary scanning direction by rotating of the endless belt 11.

The printer 1 includes a set of ink cartridges 5*a*, 5*b*, 5*c*, and 6*d*. The ink cartridges 5*a*, 5*b*, 5*c*, and 5*d* contain yellow ink, magenta ink, cyan ink, and black ink respectively. The ink cartridges 5*a*, 5*b*, 5*c*, and 5*d* are joined at one end to ink tubes 100*a*, 100*b*, 100*c*, and 100*d* respectively. The other ends of the ink tubes 100*a* to 100*d* are joined to a tube joint 20 mounted on the head unit 8. The inks in the ink cartridges 5*a* to 5*d* are supplied via the corresponding ink tubes 100*a* to 100*d* to the ink head 8. The inks received by the ink head 8 are transferred along an ink passages provided in the head unit 8 to the ink jet head 30 and delivered from their respective nozzles, not shown, of the ink jet head 30 onto the printing paper P. In the present embodiment, the ink tubes are made of a particular material such as natural rubber which is higher in the resistance to compression stress than to tensile stress (that is, having resistance properties).

(Use of Ink Tubes)

Figure 2:
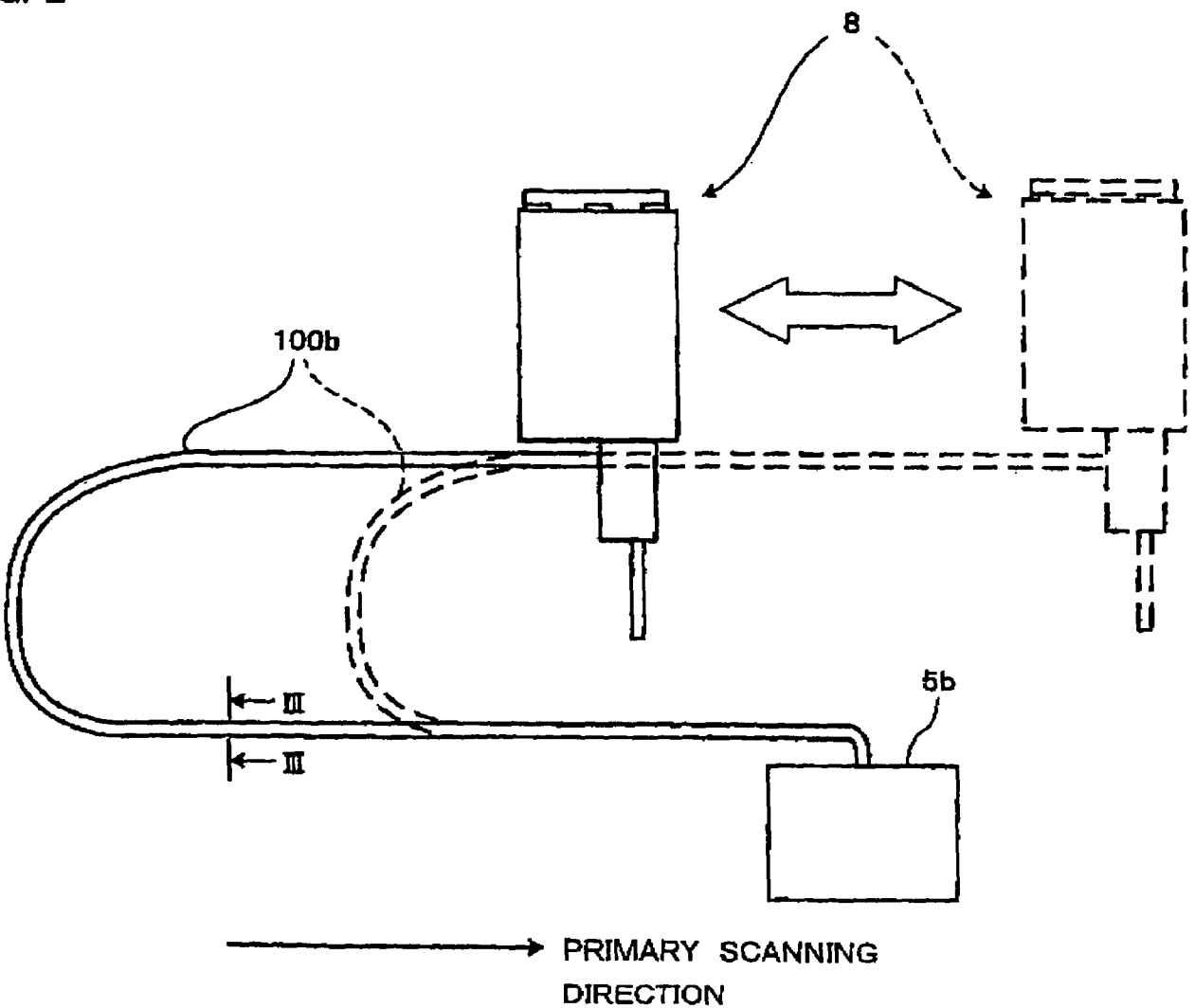
FIG. 2 shows a top view of the ink tube shown in FIG. 1 in actual use.

FIG. 2 illustrates an action of using the ink tubes in the printer 1. One 100*b* of the four ink tubes 100*a* to 100*d* is shown in FIG. 2 while the other tubes are identical in the arrangement.

As described, the head unit 8 travels forward and backward along the primary scanning direction. The ink tube 100*b* is arranged to a generous length for inhibiting from being bent at acute angles or entangled with the others regardless of the location of the head unit 8. As shown in FIG. 2, the ink tube 100*b* is joined between the head unit 8 and the ink cartridge 5*b* so that it can be curved in one direction in relation to the primary scanning direction when the head unit 8 travels forward and backward.

In this way, the ink tubes 100*a* to 100*d* are set up in the printer 1 while remaining in arcuate forms along uniform directions for a long time.

When water in the ink is evaporated, the viscosity of the ink will increase. If worse, the ink to be delivered as a jet may choke the nozzle. Alternatively, when the delivery of the ink is varied in the speed or the amount, its printing image will be declined in quality. Moreover, air may be dissolved into the ink, and thus the ink is declined in quality. As the result, the amount of the ink to be delivered will be changed and thus repeatability of its printing image is declined. When the ink tube is higher in the gas permeability through its wall, water in the ink may be evaporated to easily immigrate from the ink tube to the outside. The air may sneak into the ink tube from the outside and be easily dissolved into the ink in the ink tube.

(Details of Ink Tube)

Figure 3A:
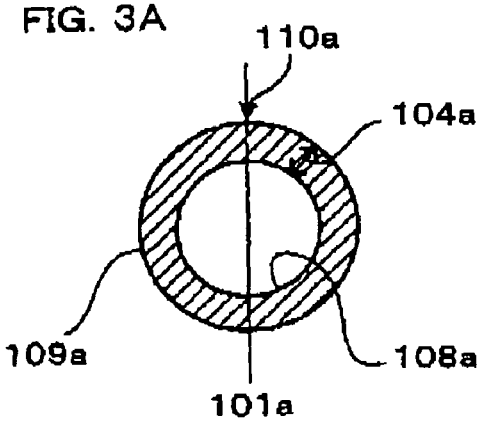
FIGS. 3A to 3E show cross sectional views of ink tubes showing prior arts and three embodiments.
Figure 3B:
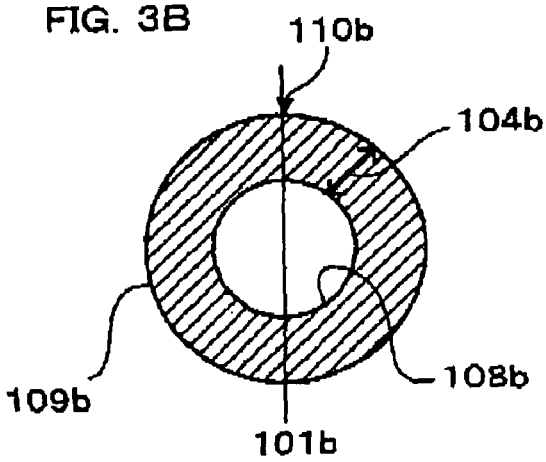

FIGS. 3A to 3E show cross sectional views vertical to the longitudinal direction of the ink tubes in various ink tubes, for example, taken along the line III-III of FIG. 2 vertically and lengthwisely. The ink tube shown in FIG. 3A has an inner surface 108*a* and an outer surface 109*a* which have a concentric circle. The ink tube shown in FIG. 3B has an inner surface 108*b* having same size and form as the inner surface 108*a* and an outer surface 109*b* having a same concentric as the inner surface 108*b*. The outer surface 109*b* is greater in size than the outer surface 109*a*. Accordingly, the thickness 104*b* of the wall of the ink tube shown in FIG. 3B is greater than the thickness 104*a* of the wall of the ink tube shown in FIG. 3A. Therefore, the ink tube shown in FIG. 3B is lower in the gas permeability than the ink tube shown in FIG. 3A. Since the thickness of its wall is increased while the inner surface and the outer surface remain concentric, the ink tube can be minimized in the gas permeability.

However, since the ink tube shown in FIG. 3B is less flexible in each direction than the ink tube shown in FIG. 3A, its application to a bent form such as shown in FIG. 2 will be unfavorable. When the ink tube shown in FIG. 3B is bent, its greater thickness will increase the resistance to compression stress or tensile stress to a higher level than that of the ink tube shown in FIG. 3A. For example, when the ink tube shown in FIG. 3B is bent to be convex towards a direction vertical to the line 101*b*, its receiving stress at the point 110*b* on the outer surface is greater than that at the point 110*a* on the outer surface of the ink tube shown in FIG. 3A which is bent to be convex towards a direction vertical to the line 101*a*. As the ink tube is remained for a long time with such a greater stress remaining urged, its quality will be possibly deteriorated.

Figure 3C:
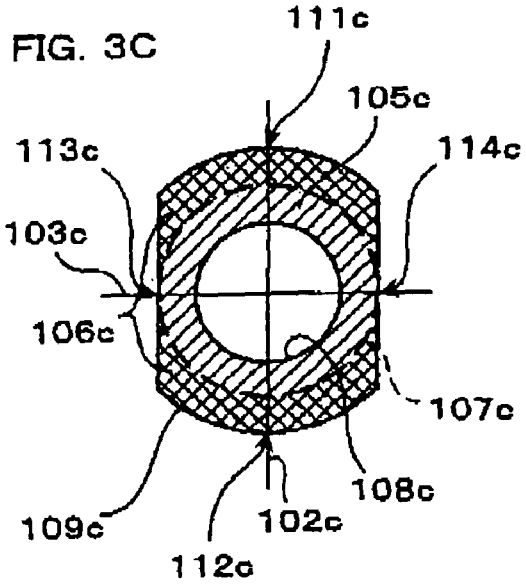
Figure 3D:
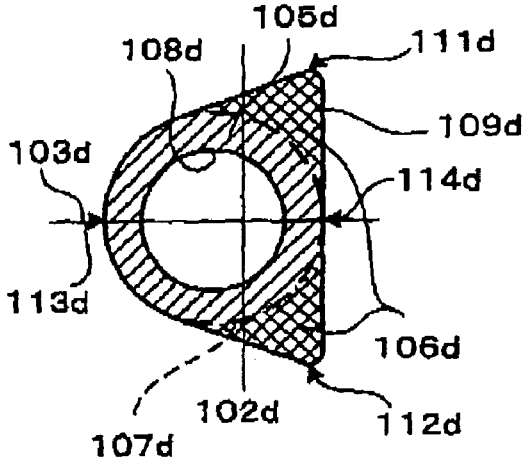
Figure 3D:
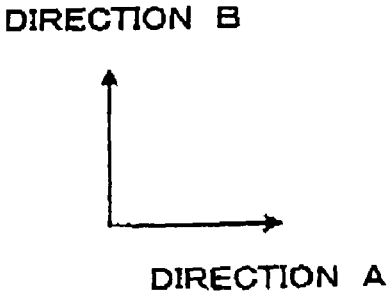
Figure 3E:
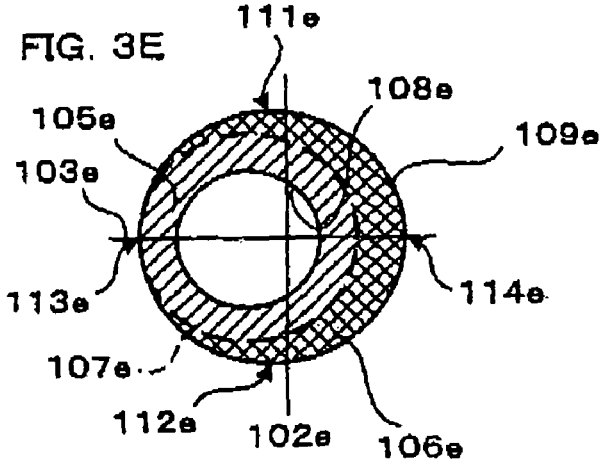

FIGS. 3C, 3D, and 3E illustrate modifications of the ink tube which are lower in the gas permeability the ink tube shown in FIG. 3A and suited for use in bent forms. The constructions of the ink tubes of the embodiment will be explained below. Their base wall parts 105*c*, 105*d*, and 105*e* are similar to the wall of the ink tube shown in FIG. 3A. That is, the base walls 105*c*, 105*d*, and 105*e* have the cross section composed of regions between the inner surface (a first closed line segment) 108*c* and its corresponding concentric circle (a second closed line segment) 107*c*, between the inner surface 108*d* and its corresponding concentric circle 107*d*, and between the inner surface 108*e* and its corresponding concentric circle 107*e*, respectively.

The ink tubes have enlarged wall parts 106*c*, 106*d*, and 106*e* thereof, respectively, which are enlarged in the thickness. Among them, the enlarged walls 106*c* and 106*d* have the cross section composed of regions between the concentric circle 107*c* and the outer surface 109*c* (a third closed line segment) which is not similar to the circle 107*c* and between the concentric circuit 107*d* and the outer surface 109*d* which is not identical in the size and form to the circle 107*c*. The enlarged wall 106*e* has the cross section composed of a region between the concentric circle 107*e* and the outer surface 109*e* (a third closed line segment) which is similar but not equal in the center to the circle 107*e*. In FIG. 3C, the outer surface 109*c* is equal in the gravity center to the circle 107*c*. In FIG. 3D, the outer surface 109*d* is not equal in the gravity center to the circle 107*d*.

Since the ink tubes are arranged in the construction as shown in FIGS. 3C to 3E, their enlarged walls are biased in at least one direction from the gravity center of the base wall at the cross section, More specifically, the enlarged walls 106*c* of the ink tube shown in FIG. 3C are biased in two opposite directions which extend in parallel with the line 102*c*. The enlarged walls 106*d* of the ink tube shown in FIG. 3D are biased from the gravity center of the base wall in two directions which extend across two divisions out of the four divisions divided by the two lines 102*d* and 103*d*. The enlarged wall 106*e* of the ink tube shown in FIG. 3E is biased in a direction which extends in parallel with the line 103*e*. The ink tubes shown in FIGS. 3C, 3D, and 3E are thickened in the wall as compared with the base wall of the ink tube, thus being low in the gas permeability.

When the ink tubes shown in FIGS. 3C to 3E are bent to be convex in two different directions A and B, their receiving stresses are different between the two directions A and B. For example, when the ink tube shown in FIG. 3D is bent to be convex in the direction B, its receiving stress becomes maximum at two points 111*d* and 112*d* on the outer surface 109*d*. More particularly, the tensile stress is received at the point 111*d* while the compression stress is received at the point 112*d*.

Alternatively, when the ink tube shown in FIG. 3D is bent to be convex in the direction A, it receives a maximum of the compression stress at a point 113*d* on the outer surface 109*d* and a maximum of the tensile stress at a point 114*d*. Since the distance between the point 114*d* and the line 102*d* or the neutral axis is shorter than the distance between the point 113*d* and the line 102*d*, the stress received at the point 114*d* is smaller than that at the point 113*d*.

As described, the stress is different between the two directions A and B in which the ink tube is bent to be convex. Further, smaller one of two levels of the stress received at the two points, one (the point 113*d* in the above description) where a maximum of the compression stress is received and the other (the point 114*d* in the description) where a maximum of the tensile stress is received, when the ink tube has been bent to be convex in the direction A is smaller than smaller one of the two levels of the stress received at the two points (111*d* and 112*d* in the description, where the two points 111*d* and 112*d* are equal in the distance from the neutral axis or the line 113*d* and thus equal in the receiving stress and the smaller stress may be received at either of the two points), one where a maximum of the compression stress is received and the other where a maximum of the tensile stress is received, when the ink tube has been bent to be convex in the direction B.

Consequently, the ink tube shown in FIG. 3D receives a smaller level of the stress at the outer surface when it is bent to be convex in the direction A than when it is bent to be convex in the direction B during the service in its bent form. Further, when the ink tube shown in FIG. 3D is bent to be convex in the direction A, its receiving stress is smaller at the point 114*d* than at the point 113*d*. It is hence preferable that the ink tube made of a particular material which is higher in the resistance to compression stress than to tensile stress is arranged to be bent so that it can receive the tensile stress at the point 114*d* on its outer surface. When the ink tube is made of a particular material which is higher in the resistance to tensile stress than to compression stress, it is then arranged to be bent (to be convex in the direction opposite to the direction A) so that it can receive the compression stress at the point 114*d* on its outer surface. This allows the ink tube to ease the stress with the action of its material for a long time in its bent form, hence minimizing the deterioration of the equality.

Similarly, the ink tube shown in FIG. 3E receives a stress smaller at the point 114*e* (of which the distance from the line 102*e* at the neutral axis is shorter than that of the point 113*e*) where the maximum of either the compression stress or the tensile stress becomes smaller when it has been bent to be convex in the direction A than at the point 111*e* (where the stress received is equal to that received at the point 112*e* and the smaller stress may be received at either of the two points 111*e* and 112*e*) where the maximum of either the compression stress or the tensile stress becomes smaller when it has been bent to be convex in the direction B. This is explained by the fact that the distance between the point 114*e* and the line 102*e* at the neutral axis is shorter than the distance between the point 111*e* and the line 103*e* at the neutral axis. Accordingly, when the ink tube shown in FIG. 3E, like the ink tube shown in FIG. 3D, is used in its bent form so that it projects in the direction A while adjusting depending on its material whether the stress received at the point 114*e* is the tensile stress or the compression stress, it can be minimized in the deterioration of the quality.

The ink tube shown in FIG. 3C is similar. The ink tube receives a stress smaller at the point 113*c* (where the stress received is equal to that received at the point 114*c* and the smaller stress may be received at either of the two points 113*c* and 114*c*) where the maximum of either the compression stress or the tensile stress becomes smaller when it has been bent to be convex in the direction A than at the point 111*c* (where the stress received is equal to that received at the point 112*c* and the smaller stress may be received at either of the two points 111*c* and 112*c*) where the maximum of either the compression stress or the tensile stress becomes smaller when it has been bent to be convex in the direction B. This is explained by the fact that the distance between the point 113*c* and the line 102*c* at the neutral axis is shorter than the distance between the point 111*c* and the line 103*c* at the neutral axis. Accordingly, when the ink tube shown in FIG. 3C, like the ink tube shown in FIG. 3D, is uses in its bent form so that it projects in the direction A during a long time, it can be minimized in the deterioration of the quality. Since the stress received at the point 113*c* is equal to that received at the point 114*c*, the ink tube shown in FIG. 3C may be used while remaining beat to be convex in the direction opposite to the direction A.

Meanwhile, the gas barrier property of the ink tube indicating whether or not gas is highly permeable depends on the wall size at the cross section of the enlarged walls of the ink tube. Assuming that the gas barrier property or the wall size at the cross section is equal, the ink tube shown in FIG. 3D among the three ink tubes shown in FIGS. 3C to 3E is capable of being bent so that the maximum of either the compression stress or the tensile stress is the smallest. More particularly, the distance between the point 114*d* and the line 102*d* at the neutral axis is shorter than both the distance between the point 113*c* and the line 102*c* and the distance between the point 114*e* and the line 102*e*.

The ink tube shown in FIG. 3C is capable of being bent so that the maximum of either the compression stress or the tensile stress is the second smallest. The distance between the point 113*c* and the line 102*c* is shorter than the distance between the point 114*e* and the line 102*e*. However, the distance between the point 113*e* and the line 102*c* may be longer than the distance between the point 114*e* and the line 102*e* when the ink tubes shown in FIGS. 3C and 3E are in the wall thickness of the enlarged walls. The distance between the point 113*c* and the line 102*c* is equal to the distance between the point 110*a* and the line 101*a* in the ink tube shown in FIG. 3A. In other words, the ink tube shown in FIG. 3C can selectively be bent so that it receives the maximum of the stress equal to that in the ink tube shown in FIG. 3A.

In the ink tube shown in FIG. 3C, the gravity center of the inner surface 108*c* coincident the gravity center of the outer surface 109*c*. As the result, the ink tube shown in FIG. 3C is balanced in the form and can thus be installed in a stable manner.

Each of the ink tubes shown in FIGS. 3C and 3D is symmetric about the symmetry axis. More specifically, the ink tube shown in FIG. 3C is symmetric about both the line 102*c* and the line 103*c* while the ink tube shown in FIG. 3D is symmetric about the line 103*d*. This allows the ink tubes to be manufactured with much ease.

The ink tubes shown in FIGS. 3C to 3E have their boundary circles 107*c* to 107*e* between the base wall and the enlarged wall arranged to overlap partially with the outer surfaces 109*c* to 109*e*, respectively. It is therefore clear that the enlarged walls are biased. This allows the ink tube to be bent to be convex in a desired direction A, for example, so that the line 102*d* at the neutral axis becomes closer to the enlarged walls. Accordingly, the distance between the neutral axis and the point (114*d*) where either the tensile stress or the compression stress is received at the maximum can be minimized, thus declining the intensity of the stress.

In the ink tubes shown in FIGS. 3C and 3D, the outer surfaces include locally linear lines. Accordingly, the ink tubes can easily be bent to be convex in a specific direction (the direction A in this embodiment) vertical to the linear lines which are parts of the outer surfaces.

The ink tube shown in FIG. 3E is different from the ink tube shown in FIG. 3B by the fact that the gravity center of the inner surface is biased in one direction. Accordingly, the ink tube shown in FIG. 3E can simply be manufactured by shifting the location of the molding center while the ink tube shown in FIG. 3B is manufactured by molding a cylindrical material in molds. In other words, the ink tubes shown in FIG. 3E can be manufactured using a simple process.

The gas barrier property of the ink tube depends on the wall size of the cross section. When the ink tubes are identical in the wall size at the cross section, they are uniform in the gas permeability. It is sufficient for the ink tubes shown in FIGS. 3C and 3D being equal in the gas barrier property to the ink tube shown in FIG. 3B is equal in the wall area to the sum at the cross section of the base wall and the enlarged walls. Accordingly, the ink tubes like the ink tube shown in FIG. 3B can be used in the bent form while remaining high in the gas barrier property.

(Optimum Use of Ink Tubes)

Figure 4A:
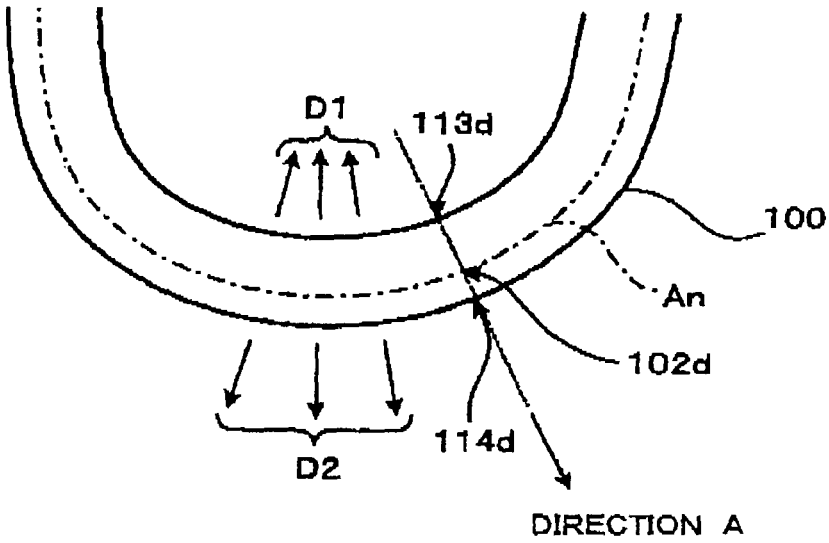
FIGS. 4A and 4B show top views of one in actual use of the ink tubes of the embodiments shown in FIGS. 3A to 3E.
Figure 4B:
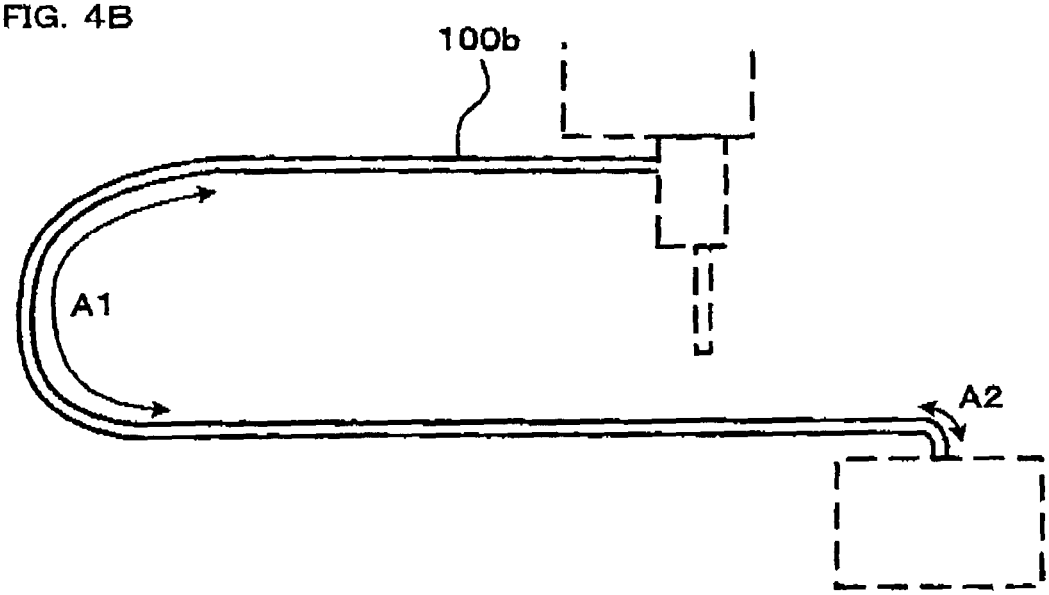

FIGS. 4A and 4B illustrate an optimum action of using any of the ink tubes shown in FIGS. 3C to 3E in the printer 1. In the printer 1, the ink tubes are used in a bent sate in the same direction as shown in FIG. 2. When the ink tube 100 has such a cross section as shown in FIG. 3D, it can be bent so that the neutral axis 102*d* extends vertical to of the drawing sheet and across a one-dot chain line An as being closer to the direction D2 which extends outwardly of the bent. Particularly, in a cross section along a dashed line in FIG. 4A, the ink tube 100 is arranged flexible so that the direction A shown in FIG. 3D coincident the direction outwardly of the bent.

As the ink tube 100 is arranged in such a manner, the maximum of its receiving stress becomes smaller than when the ink tube is bent to be convex in the direction B. Accordingly, the bent side of the ink tube 100 has the point 114*d* designated at the outer surface and the point 113*d* designated at the inner surface. In the action of the ink tube 100, the maximum of the tensile stress at the point 114*d* is smaller than the maximum of the compression stress at the point 113*d*. When installed in the printer 1, the ink tube 100 which is higher in the resistance to compression stress than in the resistance to tensile stress can easily be bent and minimized in the deterioration of the quality.

FIG. 4B illustrates the ink tube 100 remaining bent at the region A1 as shown in FIG. 4A. As shown in FIG. 4B, the ink tube 100 can be installed so that its bent region A1 bent in such a direction as shown in FIG. 4A becomes wider along the longitudinal direction than the region A2 bent in the opposite direction. The bent region of the ink tube 100 curved in such a direction that the maximum of the tensile stress is smaller than the maximum of the compression stress becomes greater in the size than the other region curved in such a direction that the maximum of the tensile stress is larger than the maximum of the compression stress. More specifically, since its region highly resistive to the deterioration is wider than the region less resistive to the same, the ink tube 100 can be minimized in the deterioration of the quality.

(Other Modifications)

Figure 5A:
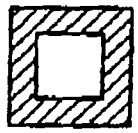
FIGS. 5A to 5K show cross sectional views of ink tubes showing the other embodiments.
Figure 5B:
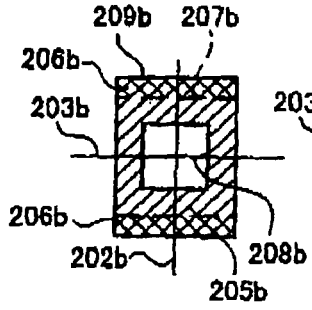
Figure 5C:
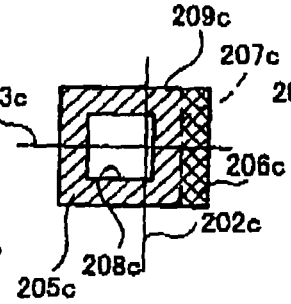
Figure 5D:
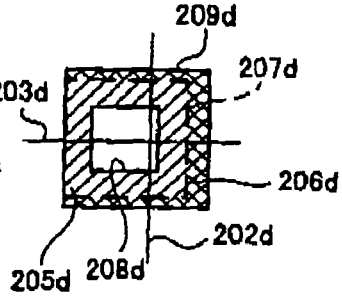
Figure 5E:
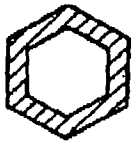
Figure 5F:
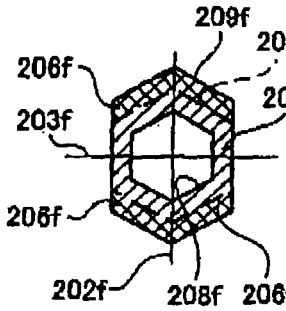
Figure 5G:
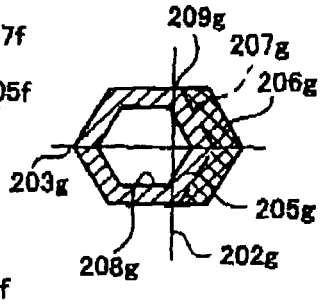
Figure 5H:
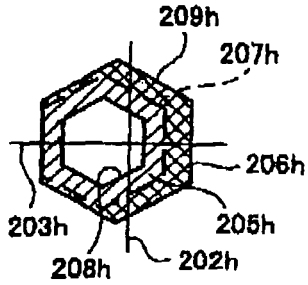
Figure 5I:
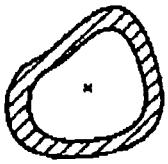

FIGS. 5A to 5K are cross sectional views showing other modifications of the ink tube. More particularly, FIGS. 5A, 5E, and 5I illustrate the ink tubes with no enlarged walls while FIGS. 5B to 5D, 5F to 5H, 5J, and 5K illustrate the ink tubes with enlarged walls. The ink tubes include the base walls 205*b* to 205*d*, 205*f* to 205*h*, 205*j*, and 205*k* respectively. Further, the ink tubes include the enlarged walls 206*b* to 206*d*, 206*f* to 206*h*, 206*j*, and 206*k* respectively.

The ink tubes may be arranged of polygonal forms at both the inner surface and the outer surface. As shown in FIGS. 5B to 5D, the base walls 205*b* to 205*d* are defined at the cross section between the inner surfaces 208*b* to 208*d* of a square form and the outer surfaces 207*b* to 207*d* of a square form of which the gravity center is equal to that of the square form of the inner surfaces 208*b* to 208*d*. As shown in FIGS. 5F to 5H, the base walls 205*f* to 205*h* are defined at the cross section between the inner surfaces 208*f* to 208*h* of a regular hexagonal form and the outer surfaces 207*f* to 207*h* of a regular hexagonal form of which the gravity center is equal to that of the regular hexagonal form of the inner surfaces 208*f* to 208*h*.

In FIGS. 5B and 5F, the enlarged walls 206*b* and 206*f* are defined as a form between the outer surfaces 209*b* and 209*f* of the base walls 205*b* and 205*f* and the outer surfaces 209*b* an 209*f* and are equal in the gravity center to the base walls 205*b* and 205*f*, respectively.

In FIGS. 5C and 5G, the enlarged walls 206*c* and 206*g* are defined as a form between the outer surfaces 209*c* and 209*g* of the base walls 205*c* and 205*g* and the outer surfaces 209*c* an 209*g* and are not equal in the gravity center to the base walls 205*c* and 205*g*, respectively.

In FIGS. 5D and 5H, the enlarged walls 206*d* and 206*h* are defined as a form between the outer surfaces 209*d* and 209*h* of the base walls 205*d* and 205*h* and the outer surfaces 209*d* an 209*h* and are not equal in the gravity center to the base walls 205*d* and 205*h* respectively. The outer surfaces 209*d* and 209*h* are identical in the form at the cross section to the inner surfaces 208*d* and 208*h*, respectively.

Figure 5J:
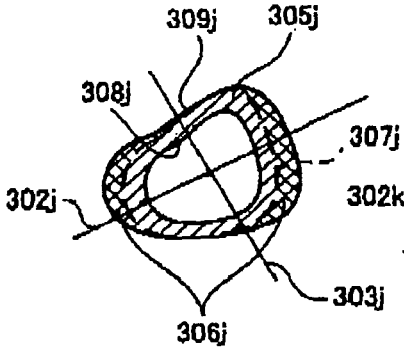
Figure 5K:
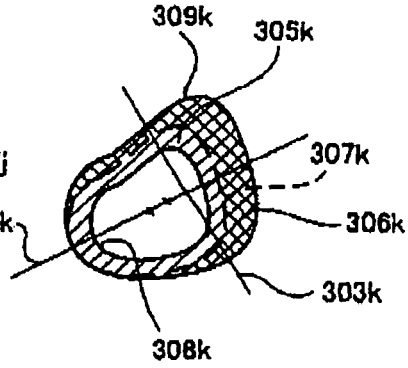
Figure 5K:
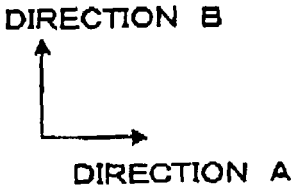
Figure 5K:
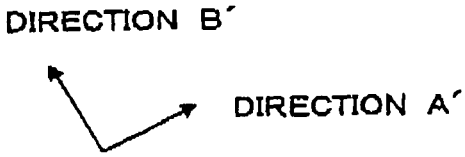

Moreover, the inner surfaces and the outer surfaces of the ink tubes are not limited to the circle, the regular polygonal form, or the symmetric form described above. For example, the ink tubes may be arranged of arbitrary forms with no symmetric axis or point as shown in FIGS. 5I to 5K. The ink tubes shown in FIGS. 5J and 5K have base walls 305*j* and 305*k* which are defined between the inner surfaces 308*j* and 308*k* arranged of non-symmetric forms and the closed line segments 309*j* and 309*k* respectively of which the forms are equal in the gravity center to the forms of the inner surfaces 308*j* and 308*k*. The base wall 305*j* of the ink tube shown in FIG. 5J is accompanied with enlarged walls 306*j* which are defined between the outer surface 309*j* of the base wall 305*j* and the outer surface 309*j* and are equal in the gravity center to the base wall 305*j*. The base wall 305*k* of the ink tube shown in FIG. 5K is accompanied with enlarged walls 306*k* which are defined between the outer surface 309*k* of the base wall 305*k* and the outer surface 309*k* and are not equal in the gravity center to the base wall 305*k*. The outer surface 309*k* is identical in the form at the cross section to the inner surface 308*k*.

In the ink tubes shown in FIGS. 5B to 5D and 5F to 5H, smaller one of the maximum of the tensile stress and the maximum of the compression stress received at the outer surface when the ink tubes are bent to be convex in the direction A is smaller than smaller one of the maximum of the tensile stress and the maximum of the compression stress received at the outer surface when the ink tubes are bent to be convex in the direction B. The lines 202*b* to 202*d* and 202*f* to 202*h* in the drawings are the neutral axes along which the ink tubes are bent to be convex in the direction A. Further, the lines 203*b* to 203*d* and 203*f* to 203*h* are the neutral axes along which the ink tubes are bent to be convex in the direction B.

In the ink tubes shown in FIGS. 5J and 5K, smaller one of the maximum of the tensile stress and the maximum of the compression stress received at the outer surface when the ink tubes are bent to be convex in a direction A' is smaller than smaller one of the maximum of the tensile stress and the maximum of the compression stress received at the outer surface when the ink tubes are bent to be convex in a direction B'. The lines 303*j* and 303*k* in the drawings are the neutral axes along which the ink tubes are bent to be convex in the direction A'. Further, the lines 302*j* and 302*k* are the neutral axes along which the ink tubes are bent to be convex in the direction B'.

The ink tube may further be in which the first closed line segment forms preferably a circle. Since its inner surface at the cross section is circular, the ink tube can permit the ink to flow easily. Further, the ink tube is equal in the form of the cross section to any conventional ink tube and can thus be manufactured by a known manner.

The ink tube may further be in which the first closed line segment forms a polygon. Since its inner surface at the cross section is polygonal, the ink tube can be increased in the strength against bending to be convex in a direction along the cross section.

In one aspect, the ink tube may be modified in which the third closed line segment and the second closed line segment are similar to each other. Since the cross section of its outer surface is similar to that of the inner surface, the ink tube can be simpler in the overall form. Accordingly, the ink tube can thus be manufactured by a simple manner.

The ink tube may further be in which the gravity center of the second closed line segment is equal to the gravity center of the third closed line segment. Since its outer and inner surfaces at the cross section are equal to each other in the gravity center, the ink tube becomes stable in the form and easy for installation.

The ink tube may further be in which the third closed line segment is arranged symmetric about a line extending across the gravity center of the first closed line segment. Since its outer surface at the cross section is symmetric, the ink tube can be manufactured with much ease.

The ink tube may further be in which the second closed line segment and the third closed line segment are arranged overlapping partially with each other. Since its wall is certainly separated between the base part and the enlarged wall, the ink tube can increase a difference between the maximum of the tensile stress and the maximum of the compression stress when being bent to be convex in a desired direction along the cross section.

The ink tube may further be in which the third closed line segment is preferably composed of arcuate parts and linear parts. Since its outer surface at the cross section includes linear parts, the ink tube can be bent with much ease.

The ink tube may further be modified, in another point of view, in which the form at the cross section is arranged vertical to the longitudinal direction of the ink tube to define two different directions A and B which satisfy (a) the requirement that the two directions extend along the cross section arranged vertical to the longitudinal direction of the ink tube and (b) the requirement that smaller one of the maximum of the tensile stress and the maximum of the compression stress received at the outer surface when the ink tube is bent to be convex in the direction A is smaller than smaller one of the maximum of the tensile stress and the maximum of the compression stress received at the outer surface when the ink tube is bent to be convex in the direction B. The maximum of either the tensile stress or the compression stress received at the outer surface of the ink tube becomes smaller when the ink tube is bent to be convex in the direction A along the cross section than when the same is bent to be convex in the direction B. Accordingly, the ink tube can selectively be bent so that the maximum of either the tensile stress or the compression stress is minimized.

The ink tube may further be in which the form at the cross section is arranged vertical to the longitudinal direction of the ink tube to define two different directions A and B which satisfy (a) the requirement that the two directions extend along the cross section arranged vertical to the longitudinal direction of the ink tube and (b) the requirement that smaller one of the maximum of the tensile stress and the maximum of the compression stress received at the outer surface when the ink tube is bent to be convex in the direction A is smaller than smaller one of the maximum of the tensile stress and the maximum of the compression stress received at the outer surface when the ink tube is bent to be convex in the direction B, provided that the maximum of the compression stress received at the outer surface when the ink tube is bent to be convex in the direction A is different from the maximum of the tensile stress received at the outer surface.

Accordingly, the maximum of either the tensile stress or the compression stress received at the outer surface of the ink tube becomes smaller when the ink tube is bent to be convex in the direction A along the cross section than when the same is bent to be convex in the directions B. Accordingly, the ink tube can selectively be bent so that the maximum of either the tensile stress or the compression stress is minimized. Moreover, the ink tube can selectively be bent to be convex in either the direction A or the direction opposite to the direction A, depending on the material of the ink tube which is highly resistant to the tensile stress or the compression stress. This allows the ink tube to be bent selectively depending on its material and held at its bent form with a minimum of deterioration.

A method of using the ink tube described above is also provided involving, when the ink tube is made of a material which is highly resistant to compression stress rather than tensile stress, bending the ink tube to be convex in either the direction A or the direction opposite to the direction A so that a region at the cross section of the ink tube satisfying the requirement that the maximum of the tensile stress received at the outer surface of the ink tube is smaller than the maximum of the compression stress received at the outer surface becomes greater in the area along the longitudinal direction of the ink tube than the other region failing to satisfy the requirement. Accordingly, when the ink tube is made of a material highly resistant to the compression stress, it can be used while receiving a smaller level of the tensile stress than that of the compression stress. This allows the ink tube to be deteriorated to minimum.

Another method of using the ink tube described above is provided involving, when the ink tube is made of a material which is highly resistant to tensile stress rather than compression stress, bending the ink tube to be convex in either the direction A or the direction opposite to the direction A so that a region at the cross section of the ink tube satisfying the requirement that the maximum of the compression stress received at the outer surface of the ink tube is smaller than the maximum of the tensile stress received at the outer surface becomes greater in the area along the longitudinal direction of the ink tube than the other region failing to satisfy the requirement. Accordingly, when the ink tube is made of a material highly resistant to the tensile stress, it can be used while receiving a smaller level of the compression stress than that of the tensile stress. This allows the ink tube to be deteriorated to minimum.

Other Embodiments

The preferred embodiments are described above. However, it is not limited to the preferred embodiments above and various changes may be made without departing from claims.

For example, the ink tube is applied to an ink jet printer of which the print head is moved along the primary scanning direction in relation to a sheet of printing paper. The ink tube is also applicable to another type of ink jet printer where the print head is fixed along the primary scanning direction in relation to a sheet of printing paper. The delivery of ink from the ink jet printer head may be conducted by any known technique.

The ink tube is not limited to the above described forms and may be arranged of any possible form at the cross section forms such as an oval form or an irregular polygonal form.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims or equivalence of such metes and abounds thereof are therefore intended to be embraced by the claims.

What is claimed is:

1. A tube for supplying a fluid therethrough comprising:

a base wall part, from the viewpoint of the cross section perpendicular to a longitudinal direction of the tube, having a region provided outside a first closed line segment, which defines an inside of the inner surface of the tube, and inside a second closed line segment, whose shape is similar to a shape of the first closed line segment and which encloses the first closed line segment, where a gravity center of the second closed line segment is coincident with a gravity center of the first closed line segment; and an enlarged wall part, from the viewpoint of the cross section perpendicular to the longitudinal direction of the tube, having a region provided outside the second closed line segment and inside a third closed line segment which encloses the second closed line segment;

wherein a shape of the third closed line segment is similar to the shape of the second closed line segment and a gravity center of the third closed line segment is different from the gravity center of the second closed line segment.

2. The tube according to claim 1;

wherein the third closed line segment is symmetric about a linear line which extends across the gravity center of the first closed line segment.

3. The tube according to claim 2;

wherein the third closed line segment is symmetric about a linear line which extends across the gravity center of the first closed line segment.

4. The tube according to claim 2;

wherein the third closed line segment overlaps partially with the second closed line segment.

5. The tube according to claim 1;

wherein the third closed line segment overlaps partially with the second closed line segment.

6. The tube according to claim 5;

wherein the third closed line segment includes at least one arcuate part and at least one linear part.

7. The tube according to claim 1;

wherein the third closed line segment includes at least one arcuate part and at least one linear part.

8. The tube according to claim 1;

wherein the first closed line segment forms a circle.

9. The tube according to claim 1;

wherein the first closed line segment forms a polygon.

10. The tube according to claim 1;

wherein material of the tube is resistant to a compression stress rather than a tensile stress.

11. The tube according to claim 1;

wherein material of the tube is resistant to a tensile stress rather than a compression stress.

12. An ink jet printer comprising:

a head for delivering a jet of ink onto a recording medium;

a cartridge for storing the ink; and the tube as set forth in claim 1 for communication between the head and the cartridge toss convey the ink from the cartridge to the head.

13. An apparatus comprising:

a movable unit which reciprocates; and a tube in which a fluid is passed and which is connected to the movable unit in a state that the tube is bent;

wherein a smaller one of a first maximum of tensile stress and a first maximum of compression stress received at an outer surface of the tube, when the tube is bent in one direction which is perpendicular to a longitudinal direction of the tube, is smaller than a smaller one of a second maximum of tensile stress and a second maximum of compression stress received at the outer surface of the tube, when the tube is bent in a direction opposite to the one direction which is perpendicular to the longitudinal direction of the tube; and wherein material of the tube is resistant to a compression stress rather than a tensile stress.

14. A method of using a tube for supplying a fluid therethrough;

the tube comprising:

a base wall part, from the viewpoint of the cross section perpendicular to a longitudinal direction of the tube, having a region provided outside a first closed line segment, which defines an inside of the inner surface of the tube, and inside a second closed line segment, whose shape is similar to a shape of the first closed line segment and which encloses the first closed line segment, where a gravity center of the second closed line segment coincident with a gravity center of the first closed line segment; and an enlarged wall part, from the viewpoint of the cross section perpendicular to the longitudinal direction of the tube, having a region provided outside the second closed line segment and inside a third closed line segment which encloses the second closed line segment;

wherein either (1) a shape of the third closed line segment is dissimilar to the shape of the second closed line segment and a gravity center of the third closed line segment is coincident with the gravity center of the second closed line segment, or (2) the shape of the third closed line segment is similar to the shape of the second closed line segment and a gravity center of the third closed line segment is different from the gravity center of the second closed line segment; and wherein material of the tube is resistant to a compression stress rather than a tensile stress;

the method comprising:

a step of bending the tube so that one region of the outer surface where, at the cross section of the tube, the maximum of the tensile stress received at the outer surface is smaller than the maximum of the compression stress received at the outer surface becomes greater in area than another region of the outer surface where the maximum of the tensile stress is greater than the maximum of the compression stress.

15. The method according to claim 14;

wherein the step of bending the tube involves bending the tube either in one direction or in a direction opposite to the one direction.

16. A method of using a tube for supplying a fluid therethrough;

the tube comprising:

a base wall part, from the viewpoint of the cross section perpendicular to a longitudinal direction of the tube, having a region provided outside a first closed line segment, which defines an inside of the inner surface of the tube, and inside a second closed line segment, whose shape is similar to a shape of the first closed line segment and which encloses the first closed line segment, where a gravity center of the second closed line segment coincident with a gravity center of the first closed line segment; and an enlarged wall part, from the viewpoint of the cross section perpendicular to the longitudinal direction of the tube, having a region provided outside the second closed line segment and inside a third closed line segment which encloses the second closed line segment;

wherein either (1) a shape of the third closed line segment is dissimilar to the shape of the second closed line segment and a gravity center of the third closed line segment is coincident with the gravity center of the second closed line segment, or (2) the shape of the third closed line segment is similar to the shape of the second closed line segment and a gravity center of the third closed line segment is different from the gravity center of the second closed line segment; and wherein material of the tube is resistant to a tensile stress rather than a compression stress;

the method comprising:

a step of bending the tube so that one region of the outer surface where, at the cross section of the tube, the maximum of the compression stress received at the outer surface is smaller than the maximum of the tensile stress received at the outer surface becomes greater in the area than another region of the outer surface where the maximum of the compression stress is greater than the maximum of the tensile stress.

17. The method according to claim 16;

wherein the step of bending the tube involves bending the tube either in one direction or in a direction opposite to the one direction.

18. A tube for supplying a fluid therethrough comprising:

a base wall part, from the viewpoint of the cross section perpendicular to a longitudinal direction of the tube, having a region provided outside a first closed line segment, which defines an inside of the inner surface of the tube, and inside a second closed line segment, whose shape is similar to a shape of the first closed line segment and which encloses the first closed line segment, where a gravity center of the second closed line segment is coincident with a gravity center of the first closed line segment; and an enlarged wall part, from the viewpoint of the cross section perpendicular to the longitudinal direction of the tube, having a region provided outside the second closed line segment and inside a third closed line segment which encloses the second closed line segment;

wherein a shape of the third closed line segment is dissimilar to the shape of the second closed line segment and a gravity center of the third closed line segment is coincident with the gravity center of the second closed line segment; and wherein the third closed line segment overlaps partially with the second closed line segment.

19. An apparatus comprising:

a movable unit which reciprocates; and a tube in which a fluid is passed and which is connected to the movable unit in a state that the tube is bent;

wherein a smaller one of a first maximum of tensile stress and a first maximum of compression stress received at an outer surface of the tube, when the tube is bent in one direction which is perpendicular to a longitudinal direction of the tube, is smaller than a smaller one of a second maximum of tensile stress and a second maximum of compression stress received at the outer surface of the tube, when the tube is bent in a direction opposite to the one direction which is perpendicular to the longitudinal direction of the tube; and wherein material of the tube is resistant to a tensile stress rather than a compression stress.

* * * * *